US010627107B2

(12) United States Patent
Hirata et al.

(10) Patent No.: US 10,627,107 B2
(45) Date of Patent: Apr. 21, 2020

(54) HYDROGEN GAS BURNER STRUCTURE AND HYDROGEN GAS BURNER DEVICE INCLUDING THE SAME

(71) Applicant: TOYOTA JIDOSHA KABUSHIKI KAISHA, Toyota-shi, Aichi-ken (JP)

(72) Inventors: Koichi Hirata, Nisshin (JP); Daisuke Sakuma, Nagoya (JP); Kenshiro Mimura, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 154 days.

(21) Appl. No.: 15/824,599

(22) Filed: Nov. 28, 2017

(65) Prior Publication Data

US 2018/0156451 A1 Jun. 7, 2018

(30) Foreign Application Priority Data

Dec. 7, 2016 (JP) ..... 2016-237895

(51) Int. Cl.
*F23D 14/02* (2006.01)
*F23D 14/62* (2006.01)
(Continued)

(52) U.S. Cl.
CPC ..... *F23D 14/02* (2013.01); *F23C 6/045* (2013.01); *F23D 14/22* (2013.01); *F23D 14/62* (2013.01);
(Continued)

(58) Field of Classification Search
CPC ..... F23D 14/02; F23D 14/22; F23D 14/62; F23D 14/58; F23D 14/105; F23D 6/045; F23D 2900/06041; F23D 2900/9901
(Continued)

(56) References Cited

U.S. PATENT DOCUMENTS 2,559,589 A * 7/1951 Brierly ..... F23D 11/10 239/544
4,099,908 A * 7/1978 Beckmann ..... B01F 5/045 239/424
(Continued)

FOREIGN PATENT DOCUMENTS

DE 19752335 A1 5/1999
EP 2993397 A1 3/2016
(Continued)

*Primary Examiner* — Steven B McAllister
*Assistant Examiner* — Daniel E. Namay
(74) *Attorney, Agent, or Firm* — Sughrue Mion, PLLC

(57) ABSTRACT

A hydrogen gas burner structure includes a first cylinder tube, a second cylinder tube, a third cylinder tube, and an ignition device. An inside of the first cylinder tube is configured such that hydrogen gas flows. A space between the first cylinder tube and the second cylinder tube is configured such that a first combustion-supporting gas containing oxygen gas flows. A space between the second cylinder tube and the third cylinder tube is configured such that a second combustion-supporting gas containing oxygen gas flows. The ignition device is configured to ignite mixed gas. The tip of the first cylinder tube is located upstream of the tips of the second and third cylinder tubes in a gas flow direction in which the hydrogen gas and the first combustion-supporting gas and the second combustion-supporting gas flow.

4 Claims, 8 Drawing Sheets

(51) Int. Cl.
*F23D 14/22* (2006.01)
*F23C 6/04* (2006.01)
*F23D 14/58* (2006.01)

(52) U.S. Cl.
CPC ..... *F23C 2900/06041* (2013.01); *F23C 2900/9901* (2013.01); *F23D 14/58* (2013.01)

(58) Field of Classification Search
USPC ..... 431/187, 10, 181
See application file for complete search history.

(56) References Cited

U.S. PATENT DOCUMENTS 4,746,286 A * 5/1988 Shirvill ..... F23D 14/16 431/328
4,845,940 A * 7/1989 Beer ..... F23C 6/045 60/732
5,692,891 A * 12/1997 Chow ..... F23D 14/58 431/354
5,743,723 A * 4/1998 Iatrides ..... F23D 1/00 431/12
5,785,721 A * 7/1998 Brooker ..... C10J 3/506 239/419.5
5,814,125 A * 9/1998 Anderson ..... B01F 3/0473 75/414
5,871,343 A * 2/1999 Baukal, Jr. ..... F23D 14/22 239/422
5,882,184 A * 3/1999 Feldermann ..... F23D 14/24 239/424.5
5,904,475 A * 5/1999 Ding ..... F23D 14/22 431/10
5,979,342 A * 11/1999 Leisse ..... F23D 1/02 110/104 B
6,142,764 A * 11/2000 Anderson ..... F23D 14/22 431/8
6,360,677 B1 * 3/2002 Robillard ..... F23D 11/101 110/260
6,682,339 B2 * 1/2004 Cho ..... F23D 14/22 431/187
6,776,610 B2 * 8/2004 Lovgren ..... F23D 14/62 126/91 A
9,017,067 B2 * 4/2015 Cao ..... F23D 14/32 110/204
2002/0028415 A1 * 3/2002 Cho ..... C03B 19/1415 431/187
2003/0108834 A1 * 6/2003 Pelton ..... F23D 14/22 431/8
2004/0076916 A1 * 4/2004 Lovgren ..... F23D 14/62 431/187
2004/0112091 A1 * 6/2004 Roba ..... C03B 37/0142 65/414
2004/0234912 A1 * 11/2004 Sarv ..... F23D 1/00 431/183
2006/0000395 A1 * 1/2006 Joshi ..... F23D 14/22 110/267
2007/0254251 A1 * 11/2007 Cao ..... F23C 6/047 431/10
2009/0035709 A1 * 2/2009 Mennie ..... F23G 7/065 431/5
2009/0220899 A1 * 9/2009 Spangelo ..... F23D 14/22 431/8
2009/0325110 A1 * 12/2009 Mahoney ..... F23D 14/22 431/11
2010/0081098 A1 * 4/2010 D'Agostini ..... F23C 6/04 431/5
2012/0073332 A1 * 3/2012 Yoshida ..... C03B 19/1423 65/531
2013/0145973 A1 * 6/2013 Wang ..... F23D 1/00 110/263
2015/0050605 A1 * 2/2015 Desi-Seulean ..... F23D 14/62 431/9
2016/0076763 A1 * 3/2016 Batz ..... F23C 6/047 431/187
2016/0130168 A1 * 5/2016 Cowles ..... C03B 5/2356 65/346
2016/0298839 A1 * 10/2016 Ekman ..... F23C 5/06
2018/0058688 A1 * 3/2018 Faulkinbury ..... C03B 5/167

FOREIGN PATENT DOCUMENTS

JP 2777106 B2 7/1998
JP 2007-162993 A 6/2007
JP 2010-024075 A 2/2010
JP 2011075174 A * 4/2011 ..... F23R 3/346
JP 4910129 B2 4/2012
WO 2008023011 A1 2/2008

* cited by examiner

HYDROGEN GAS BURNER STRUCTURE AND HYDROGEN GAS BURNER DEVICE INCLUDING THE SAME

INCORPORATION BY REFERENCE

The disclosure of Japanese Patent Application No. 2016-237895 filed on Dec. 7, 2016 including the specification, drawings and abstract is incorporated herein by reference in its entirety.

BACKGROUND

1. Technical Field

The present disclosure relates to a hydrogen gas burner structure using a hydrogen gas as a fuel gas, and a hydrogen gas burner device including the same.

2. Description of Related Art

In the related art, gas burner devices (combustion burner devices) using hydrogen gas as a fuel gas have been suggested. In these gas burner devices, a flame is generated by igniting mixed gas, which is obtained by mixing the hydrogen gas and oxygen gas with each other, with an ignition device.

For example, the structure of a gas burner device described below is suggested in Japanese Unexamined Patent Application Publication No. 2007-162993 (JP 2007-162993 A). With the structure of the gas burner device, an inner tube and an outer tube are concentrically disposed, an oxygen-containing gas flow passage is formed in the inner tube, and a fuel gas flow passage is formed between the inner tube and the outer tube. Moreover, a tip of the inner tube is blocked by a cover, and a plurality of jetting holes that jets an oxygen-containing gas to the fuel gas flow passage in a radial direction is formed in a circumferential direction and a longitudinal direction of the inner tube. Moreover, an ignition device that ignites mixed gas obtained by mixing the oxygen-containing gas and a fuel gas with each other is disposed on an outer wall surface of the inner tube upstream of the through-holes.

With the structure of the gas burner device related to JP 2007-162993 A, since the tip of the inner tube is blocked by the cover, the oxygen-containing gas jet in the radial direction from the jetting holes formed in the inner tube is mixed with the fuel gas. Since the ignition device is disposed upstream of the through-holes, combustion of the mixed gas occurs in a stepwise manner from an upstream side toward a downstream side by the ignition performed by the ignition device. Accordingly, there is no local temperature rise, and generation of NOx can be suppressed.

SUMMARY

However, in a case where the hydrogen gas is used as a fuel gas for the structure of the gas burner device illustrated in JP 2007-162993 A, the combustion speed of the hydrogen gas is higher than that of a hydrocarbon gas, such as town gas. Therefore, combustion of the hydrogen gas progresses at a time before the hydrogen gas is diffused. For this reason, the temperature of a flame portion of the combusted hydrogen gas tends to be higher than that of the town gas, NOx is generated by an oxidation reaction of $N_2$ in the air, and a relatively large amount of NOx is easily contained in an exhaust gas after combustion.

The present disclosure provides a hydrogen gas burner structure and a hydrogen gas burner device including the same capable of suppressing a temperature rise of a flame to reduce the concentration of NOx in an exhaust gas after combustion by performing slow combustion even in a case where hydrogen gas is used as a fuel gas.

As a result of keen studies, the inventors have found that the hydrogen gas and a combustion-supporting gas are not actively mixed with each other when the combustion-supporting gas containing oxygen gas is released around the hydrogen gas in the same direction as a direction in which the hydrogen gas that is the fuel gas is released. Accordingly, the inventors have found that diffusive combustion can be realized by suppressing progress of combustion at a time, for example, even when the hydrogen gas with a higher combustion speed than that of the hydrocarbon gas, such as town gas, is used.

The present disclosure is based on the above-described finding. A first aspect of the present disclosure relates to a hydrogen gas burner structure including a first cylinder tube of which a tip is open; a second cylinder tube disposed outside the first cylinder tube concentrically with the first cylinder tube; a third cylinder tube disposed outside the second cylinder tube concentrically with the first cylinder tube and the second cylinder tube; and an ignition device disposed inside the second cylinder tube. An inside of the first cylinder tube is configured such that hydrogen gas flows toward the tip of the first cylinder tube. A space between the first cylinder tube and the second cylinder tube is configured such that a first combustion-supporting gas containing oxygen gas, for primary combustion of the hydrogen gas, flows toward a tip of the second cylinder tube. A space between the second cylinder tube and the third cylinder tube is configured such that a second combustion-supporting gas containing oxygen gas, for secondary combustion of the hydrogen gas, flows toward a tip of the third cylinder tube. The ignition device is configured to ignite mixed gas obtained by mixing the hydrogen gas and the first combustion-supporting gas with each other. The tip of the first cylinder tube is located upstream of the tips of the second and third cylinder tubes in a gas flow direction in which the hydrogen gas and the first combustion-supporting gas and the second combustion-supporting gas flow.

According to the first aspect of the present disclosure, a first flow passage through which the hydrogen gas flows is formed in the first cylinder tube. A second flow passage through which the first combustion-supporting gas for the primary combustion of the hydrogen gas flows toward the tip of the second cylinder tube is formed between the first cylinder tube and the second cylinder tube. The first cylinder tube and the second cylinder tube are concentrically disposed. Accordingly, the hydrogen gas released from the first flow passage flows in substantially the same direction so as to surround the first combustion-supporting gas released from the second flow passage. For this reason, the hydrogen gas and the first combustion-supporting gas are not actively mixed with each other. In the above-described state, even when the mixed gas in which the hydrogen gas and the first combustion-supporting gas are mixed with each other is ignited by the ignition device in a region where the hydrogen gas and the first combustion-supporting gas are partially mixed with each other, slow primary combustion occurs due to the hydrogen gas and the first combustion-supporting gas irrespective of a combustion load.

Moreover, a third flow passage through which a second combustion-supporting gas for secondary combustion of the hydrogen gas flows is formed between the second cylinder tube and the third cylinder tube. The second cylinder tube and the third cylinder tube are concentrically disposed. Hence, the second combustion-supporting gas is also not actively mixed with the hydrogen gas that has not been combusted by the first combustion-supporting gas. Accordingly, slow secondary combustion occurs due to the uncombusted hydrogen gas and the second combustion-supporting gas.

In the hydrogen gas burner structure according to the first aspect of the present disclosure, the tip of the third cylinder tube may be located upstream of the tip of the second cylinder tube in the gas flow direction.

In the hydrogen gas burner structure according to the first aspect of the present disclosure, the first cylinder tube may include a through-hole, which allows an inside and an outside of a tube wall of the first cylinder tube to communicate with each other, in the tube wall in the vicinity of the tip of the first cylinder tube. The ignition device may be disposed downstream of the through-hole in the gas flow direction.

A second aspect of the present disclosure relates to a hydrogen gas burner device including the hydrogen gas burner structure; and a control device configured to control flow rates of the hydrogen gas to be supplied to the hydrogen gas burner structure and at least the first combustion-supporting gas. The first combustion-supporting gas and the second combustion-supporting gas are the same combustion-supporting gas. The control device is configured to control the flow rate of the first combustion-supporting gas such that the flow rate of the first combustion-supporting gas is lower than a flow rate at which the hydrogen gas is completely combusted and is lower than a flow rate of the second combustion-supporting gas.

As described above, with the hydrogen gas burner structure and the hydrogen gas burner device of the present disclosure, since the hydrogen gas, which has not been combusted in the primary combustion after the above-described primary combustion between the hydrogen gas and the first combustion-supporting gas, can be subjected to the above-described secondary combustion by the second combustion-supporting gas that flows around the hydrogen gas, the hydrogen gas can be slowly combusted. Accordingly, even in a case where the hydrogen gas is used as a fuel gas, generation of NOx in an exhaust gas after combustion can be reduced by suppressing a temperature rise of a flame by virtue of the slow combustion.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Hereinafter, two embodiments of a hydrogen gas burner device including a hydrogen gas burner structure and the hydrogen gas burner structure will be described referring to FIGS. 1 to 5.

First Embodiment—Hydrogen Gas Burner Device

Figure 1:
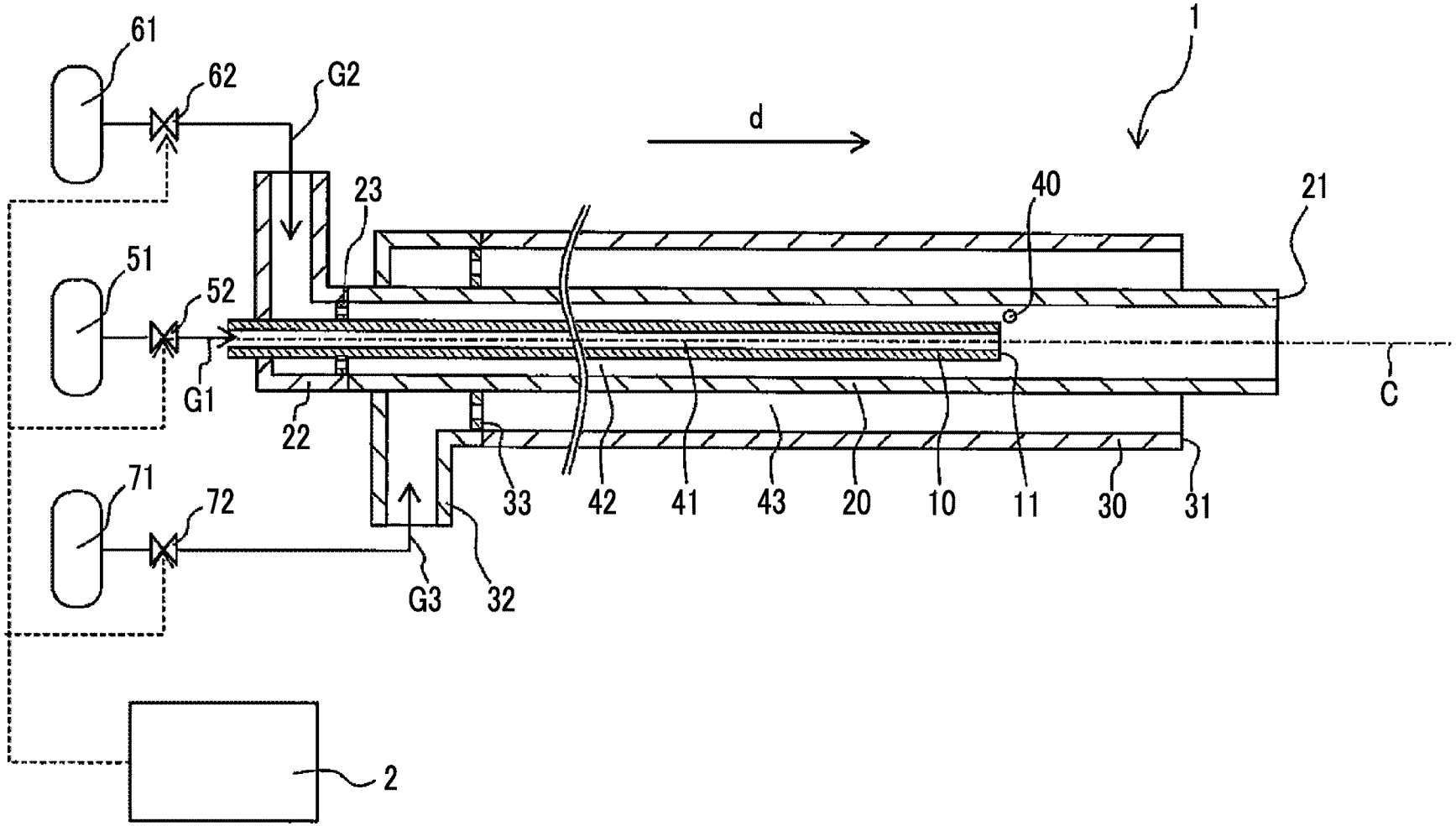
FIG. 1 is a schematic sectional view of a hydrogen gas burner device including a hydrogen gas burner structure according to a first embodiment.
Figure 2:
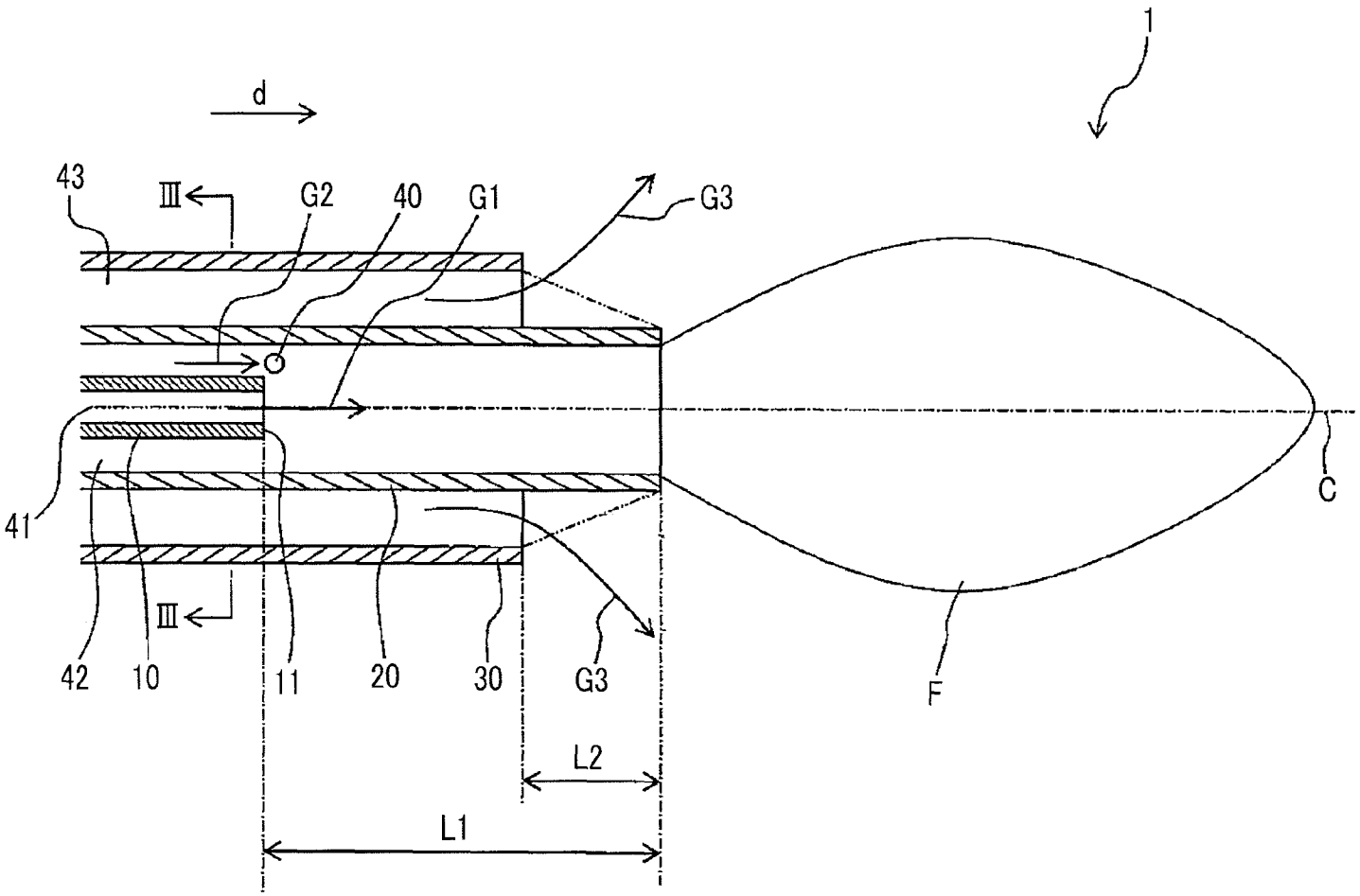
FIG. 2 is a sectional view in the vicinity of a tip of the hydrogen gas burner structure illustrated in FIG. 1.
Figure 3:
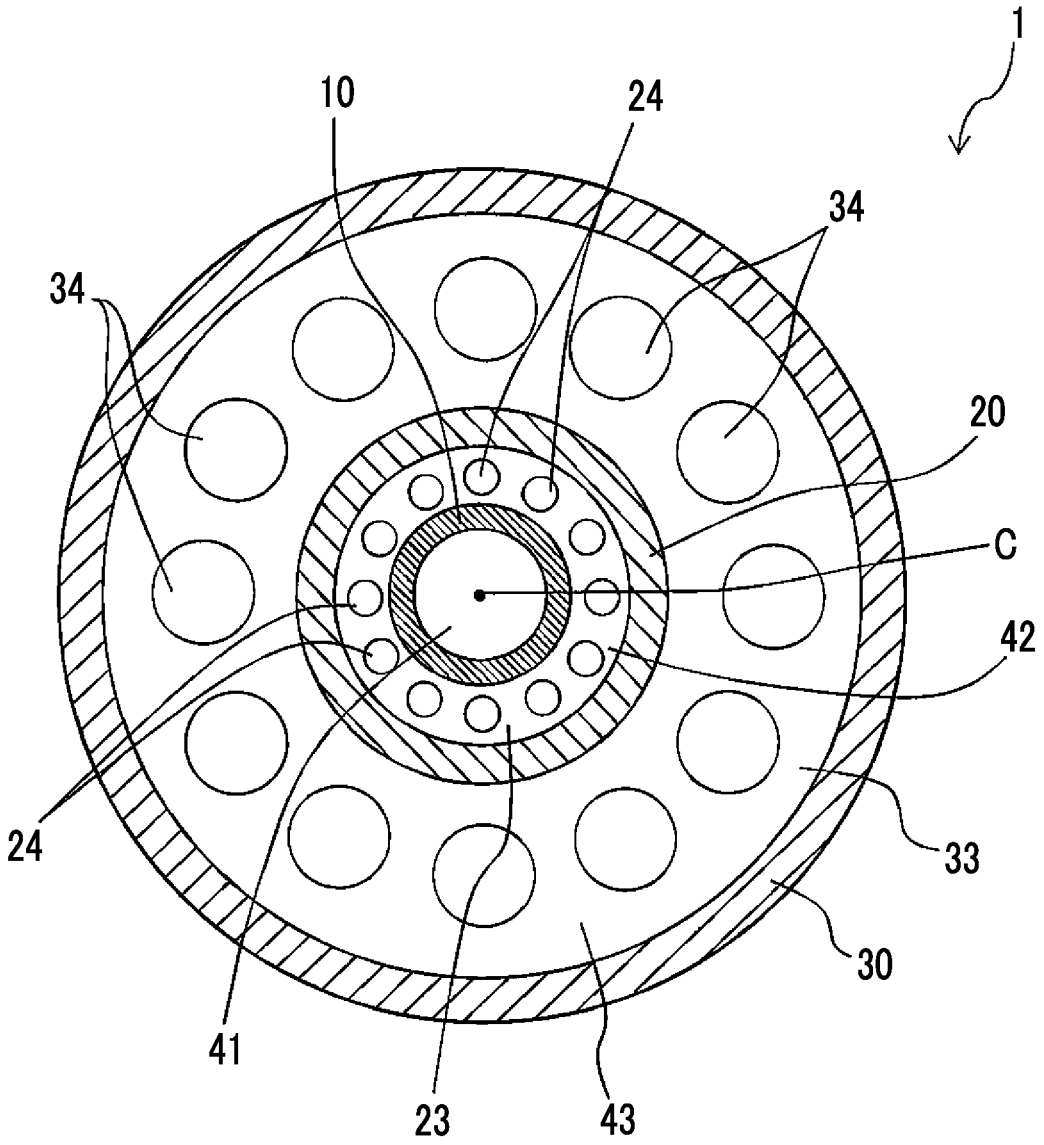
FIG. 3 is a sectional view in an arrow direction taken along line III-III illustrated in FIG. 2.

FIG. 1 is a schematic sectional view of a hydrogen gas burner device 100 including a hydrogen gas burner structure 1 according to a first embodiment. FIG. 2 is a sectional view in the vicinity of a tip of the hydrogen gas burner structure 1 illustrated in FIG. 1. FIG. 3 is a sectional view in an arrow direction taken along line III-III illustrated in FIG. 2.

As illustrated in FIG. 1, the hydrogen gas burner device 100 according to the first embodiment is a hydrogen gas burner device having hydrogen gas G1 as fuel, and at least includes the hydrogen gas burner structure 1, and a control device 2 that controls the flow rates of the hydrogen gas G1 and at least a first combustion-supporting gas G2 to be described below. As illustrated in FIGS. 1 to 3, the hydrogen gas burner structure 1 includes a first cylinder tube 10, a second cylinder tube 20, and a third cylinder tube 30 that are concentrically (the same central axis C) disposed from the inside on a tip side of the hydrogen gas burner structure 1. The first cylinder tube 10, the second cylinder tube 20, and the third cylinder tube 30 are made of, for example, metallic materials, such as stainless steel.

A first flow passage 41 through which the hydrogen gas G1 flows as a fuel gas toward a tip 11 of the first cylinder tube 10 is formed inside the first cylinder tube 10. Specifically, a hydrogen gas supply source 51 is connected to the first cylinder tube 10 via a flow rate adjusting valve 52. The tip 11 of the first cylinder tube 10 is open, and a circular opening is formed at the tip 11. As described above, the inside of the first cylinder tube 10 is the first flow passage 41 through which the hydrogen gas G1 flows, and in the first flow passage 41, the hydrogen gas G1 is caused to flow in a direction (gas flow direction d) along the central axis C, and the hydrogen gas G1 can be released from the tip 11.

A tip 21 of the second cylinder tube 20 is open, and a circular opening is formed at the tip 21. A second flow passage 42 through which the first combustion-supporting gas G2 containing oxygen gas flows toward the tip 21 of the second cylinder tube 20 is formed between the first cylinder tube 10 and the second cylinder tube 20. Specifically, the second cylinder tube 20 is connected by a connecting part 22 in a state where the first cylinder tube 10 is inserted, and the connecting part 22 is connected to a first combustion-supporting gas supply source 61 via a flow rate adjusting valve 62.

Here, the first combustion-supporting gas G2 is a primary combustion gas of the hydrogen gas G1. A second combustion-supporting gas G3 to be described below is a secondary combustion gas for combusting the hydrogen gas G1 that has not been combusted due to shortage of the first combustion-supporting gas G2. The first combustion-supporting gas G2 and the second combustion-supporting gas G3 may be gases containing oxygen gas. For example, a gas obtained by mixing an inert gas with air (ambient air) or oxygen gas can be included.

As illustrated in FIGS. 1 and 3, a straightening plate 23 in which a plurality of through-holes 24 is formed is disposed inside the connecting part 22 located at a base end of the second cylinder tube 20. Accordingly, the second flow passage 42 through which the first combustion-supporting gas G2 for primary combustion of the hydrogen gas G1 flows is formed between the first cylinder tube 10 and the second cylinder tube 20. In the second flow passage 42 downstream of the straightening plate 23, the first combustion-supporting gas G2 supplied to the second cylinder tube 20 is caused to flow in the direction (gas flow direction d) along the central axis C. In addition, in the present embodiment, the first combustion-supporting gas G2 is caused to flow in the gas flow direction d by the straightening plate 23. However, when the flow as described above can be formed in the first combustion-supporting gas G2, the structure is not particularly limited.

A tip 31 of the third cylinder tube 30 is open, and a circular opening is formed at the tip 31. A third flow passage 43 through which the second combustion-supporting gas G3 containing oxygen gas flows toward the tip 31 of the third cylinder tube 30 is formed between the second cylinder tube 20 and the third cylinder tube 30 of the hydrogen gas burner structure 1. Specifically, the third cylinder tube 30 is connected by a connecting part 32, and the connecting part 32 is connected to a second combustion-supporting gas supply source 71 via a flow rate adjusting valve 72.

A straightening plate 33 in which a plurality of through-holes 34 is formed is disposed inside the connecting part 32 located at a base end of the third cylinder tube 30. Accordingly, the third flow passage 43 through which the second combustion-supporting gas G3 for secondary combustion of the hydrogen gas G1 flows is formed between the second cylinder tube 20 and the third cylinder tube 30. In the third flow passage 43 downstream of the straightening plate 33, the second combustion-supporting gas G3 supplied to the third cylinder tube 30 is caused to flow in the direction (gas flow direction d) along the central axis C. In addition, in the present embodiment, the second combustion-supporting gas G3 is caused to flow in the gas flow direction d by the straightening plate 33. However, when the flow as described above can be formed in the second combustion-supporting gas G3, the structure is not particularly limited.

In the present embodiment, as a preferable aspect, the cross-sectional area of the second flow passage 42 is smaller than the cross-sectional area of the third flow passage 43. Accordingly, a state where the flow rate of the first combustion-supporting gas G2 flowing through the second flow passage 42 is lower than the flow rate of the second combustion-supporting gas G3 flowing through the third flow passage 43 can be more simply realized. As a result, the hydrogen gas G1 that has not been combusted in the primary combustion can be completely combusted through the secondary combustion using the second combustion-supporting gas G3 without completely combusting the hydrogen gas G1 through the primary combustion using the first combustion-supporting gas G2.

When the above-described first, second, and third flow passages 41, 42, 43 can be formed, the sizes of the first, second, and third cylinder tubes 10, 20, and 30 are not particularly limited. For example, it is preferable that the external diameter of the first cylinder tube 10 is 5 mm to 50 mm, the internal diameter thereof is 4 mm to 30 mm, and the thickness thereof is 1 mm to 11 mm. It is considered the external diameter of the second cylinder tube 20 is 30 mm to 200 mm, the internal diameter thereof is 25 mm to 180 mm, and the thickness thereof is 1 mm to 11 mm. Additionally, it is considered that the external diameter of the third cylinder tube 30 is 45 mm to 250 mm, the internal diameter thereof is 35 mm to 220 mm, and the thickness thereof is 1 mm to 16 mm. Moreover, it is considered that the lengths of the first to the third cylinder tubes are 90 mm to 220 mm.

In the present embodiment, the tip 11 of the first cylinder tube 10 is located upstream of the tips 21, 31 of the second and third cylinder tubes 20, 30 in the gas flow direction d in which the hydrogen gas G1 and the first and second combustion-supporting gases G2, G3 flow. Moreover, the tip 31 of the third cylinder tube 30 is located upstream of the tip 21 of the second cylinder tube 20 in the gas flow direction d.

For example, although a distance L1 between the tip 11 of the first cylinder tube 10 and the tip 21 of the second cylinder tube 20 is not particularly limited when stable primary combustion is possible by the hydrogen gas G1 and the first combustion-supporting gas G2, the distance is 100 mm to 210 mm. Moreover, a distance L2 between the tip 21 of the second cylinder tube 20 and the tip 31 of the third cylinder tube 30 is also not particularly limited when the hydrogen gas G1 that has not been combusted due to the shortage of the first combustion-supporting gas G2 can be combusted. However, from the experimental results of the inventors to be described below, the distance L2 is larger than at least 0 mm and, for example, is set to 10 mm to 130 mm. Accordingly, the amount of generation of NOx of an exhaust gas after combustion can be reduced irrespective of the combustion load rate of the hydrogen gas burner device 100 to be adjusted, by virtue of the above-described hydrogen gas burner structure 1 and the adjustment of the valve opening degrees of the flow rate adjusting valves 52, 62, 72.

Moreover, the hydrogen gas burner structure 1 includes an ignition device 40 exemplified as, for example, an ignition plug for a pilot burner, or the like. In FIGS. 1 and 2, the structure of the ignition device 40 is simplified and described, and an ignition position (a tip of an ignition rod) of the ignition device 40 is illustrated.

The ignition device 40 ignites mixed gas, in which the hydrogen gas G1 and the first combustion-supporting gas G2 are mixed with each other, inside the second cylinder tube 20. Specifically, in the present embodiment, the hydrogen gas G1 and the first combustion-supporting gas G2 are mixed with each other in the vicinity of the tip 11 of the first cylinder tube 10. Thus, the ignition device 40 is disposed in the vicinity of the tip 11 of the first cylinder tube 10.

The control device 2 controls (adjusts) the flow rates of the respective gases so as to adjust the valve opening degrees of the flow rate adjusting valves 52, 62, 72 based on control signals output from the control device 2 and so as to supply the respective gases to the hydrogen gas burner structure 1 at the set flow rates of the respective gases. Specifically, first, the control device 2 sets the flow rate of the hydrogen gas G1 in accordance with the combustion load rate (the rate of output heat quantity) of the hydrogen gas burner device 100, and sets the flow rates of the first combustion-supporting gas G2 and the second combustion-supporting gas G3 according to the setting of the flow rate of the hydrogen gas G1. In this case, a throttle valve for flow speed control (not illustrated) may be further provided such that a flow speed at which the hydrogen gas G1 is released from the tip 11 of the first cylinder tube 10 reaches at least 15 m/s at a minimum value of the combustion load rate of the hydrogen gas burner device 100.

The setting of the flow rates of the first combustion-supporting gas G2 and second combustion-supporting gas G3 is performed as follows. Specifically, the flow rates of the first combustion-supporting gas G2 and the second combustion-supporting gas G3 are set such that the flow rate of the first combustion-supporting gas G2 flowing through the second flow passage 42 is lower than a flow rate at which the hydrogen gas G1 flowing to the first flow passage 41 is completely combusted and is lower than the flow rate of the second combustion-supporting gas G3 flowing through the third flow passage 43.

In addition, it is preferable that the flow rate of the first combustion-supporting gas G2 is set to a flow rate of 5% or less of the flow rate at which the hydrogen gas G1 flowing to the first flow passage 41 is completely combusted. Additionally, it is preferable that the flow rate of the second combustion-supporting gas G3 is set to a flow rate at which the hydrogen gas G1 that has not been combusted can be completely combusted.

As described above, the control device 2 drives the flow rate adjusting valves 52, 62, 72, and adjusts the flow rates of the hydrogen gas G1 and the first and second combustion-supporting gases G2, G3 such that the flow rates of the respective gases become set flow rates. In the present embodiment, an example including the control device 2 has been illustrated as a preferable aspect. However, in a case where the control device 2 is not included, the flow rates of the gases flowing through the flow rate adjusting valves 52, 62, 72 may be directly and manually adjusted. Additionally, the ignition timing of the ignition device 40 may be controlled by the control device 2. Moreover, when the second combustion-supporting gas G3 can be supplied at a sufficient flow rate capable of completely combusting the hydrogen gas G1 that has not been combusted, the flow rate of the second combustion-supporting gas G3 may be made constant, and the control device 2 may not control the flow rate of the second combustion-supporting gas G3, and may control the flow rate of the hydrogen gas G1 and the first combustion-supporting gas G2.

2. Method of Combusting Hydrogen Gas G1 Using Hydrogen Gas Burner Structure 1

In the present embodiment, the hydrogen gas G1 is combusted by the drive control of the flow rate adjusting valves 52, 62, 72 performed by the control device 2, using the hydrogen gas burner device 100 illustrated in FIG. 1, in a state where the flow rates of the hydrogen gas G1 and the first and second combustion-supporting gases G2, G3 satisfy the following relationship.

Specifically, the hydrogen gas G1 and the first combustion-supporting gas G2 are caused to flow such that the flow rate of the first combustion-supporting gas G2 flowing through the second flow passage 42 is lower than the flow rate at which the hydrogen gas G1 flowing to the first flow passage 41 is completely combusted. In addition, the first combustion-supporting gas G2 and second combustion-supporting gas G3 are caused to flow such that the flow rate of the first combustion-supporting gas G2 flowing through the second flow passage 42 is lower than the flow rate of the second combustion-supporting gas G3 flowing through the third flow passage 43.

The mixed gas obtained by mixing the hydrogen gas G1 and the first combustion-supporting gas G2 with each other is ignited by the ignition device 40 while the above-described relationship between the flow rates of the hydrogen gas G1 the first and second combustion-supporting gases G2, G3 is satisfied.

In the present embodiment, the hydrogen gas G1 released from the first flow passage 41 and the first combustion-supporting gas G2 released from the second flow passage 42 flow in substantially the same direction due to the first cylinder tube 10 and the second cylinder tube 20 that are concentrically disposed. For this reason, the hydrogen gas G1 and the first combustion-supporting gas G2 are not actively mixed with each other inside the second cylinder tube 20. Moreover, since the tip 11 of the first cylinder tube 10 is located upstream of the tip 21 of the second cylinder tube 20, the first combustion-supporting gas G2 can be released so as to surround the hydrogen gas G1 inside the second cylinder tube 20 downstream of the tip 11 of the first cylinder tube 10.

In the above-described state, the mixed gas is ignited by the ignition device 40 in a region where the hydrogen gas G1 and the first combustion-supporting gas G2 are partially mixed with each other inside the second cylinder tube 20 downstream of the tip 11 of the first cylinder tube 10. Accordingly, slow primary combustion occurs due to the hydrogen gas G1 and the first combustion-supporting gas G2. Additionally, in the present embodiment, the flow rate of the first combustion-supporting gas G2 flowing through the second flow passage 42 is lower than the flow rate at which the hydrogen gas G1 flowing to the first flow passage 41 is completely combusted. Therefore, in the primary combustion, it is considered that the complete combustion of the hydrogen gas G1 is suppressed and the slow combustion thereof is performed. In the slow combustion, it is considered that the temperature of a flame F is difficult to increase extremely and generation of NOx is also suppressed.

In the present embodiment, it is difficult for the second combustion-supporting gas G3 released from the third flow passage 43 to flow in a direction intersecting the central axis C due to the second cylinder tube 20 and the third cylinder tube 30 that are concentrically disposed. Hence, the second combustion-supporting gas G3 is also not actively mixed with the hydrogen gas G1 that has not been combusted by the first combustion-supporting gas G2. Accordingly, slow secondary combustion occurs due to the uncombusted hydrogen gas G1 and the second combustion-supporting gas G3.

Additionally, in the present embodiment, the control device 2 performs control such that the flow rate of the first combustion-supporting gas G2 flowing through the second flow passage 42 is lower than the flow rate of the second combustion-supporting gas G3 flowing through the third flow passage 43. Accordingly, the primary combustion of the hydrogen gas G1 by the first combustion-supporting gas G2 is limited, and the uncombusted hydrogen gas G1 is secondarily combusted by the second combustion-supporting gas G3 that flows around the hydrogen gas G1.

Since the hydrogen gas G1 can be diffusively combusted by the primary combustion and the secondary combustion as described above, a rise in the temperature of the flame F can be suppressed. Accordingly, the concentration of NOx in a combusted exhaust gas can be reduced, and the lifespan of the hydrogen gas burner device 100 can be improved. Moreover, since the hydrogen gas G1 is diffusively combusted even when the hydrogen gas G1 has a higher combustion speed than a hydrocarbon gas, the backfire heading toward an upstream side in the gas flow direction d can be reduced.

Particularly, since the tip 31 of the third cylinder tube 30 is located upstream of the tip 21 of the second cylinder tube 20 in the gas flow direction d, the second combustion-supporting gas G3 flowing through the third flow passage 43 is radially discharged in a direction away from the central axis C. Accordingly, the uncombusted hydrogen gas G1 in the primary combustion can be secondarily combusted by the second combustion-supporting gas G3 such that a reaction time becomes longer. As a result, as will be described below, NOx in an exhaust gas after combustion can be reduced irrespective of the combustion load rate of the hydrogen gas burner device 100.

Second Embodiment

Figure 4:
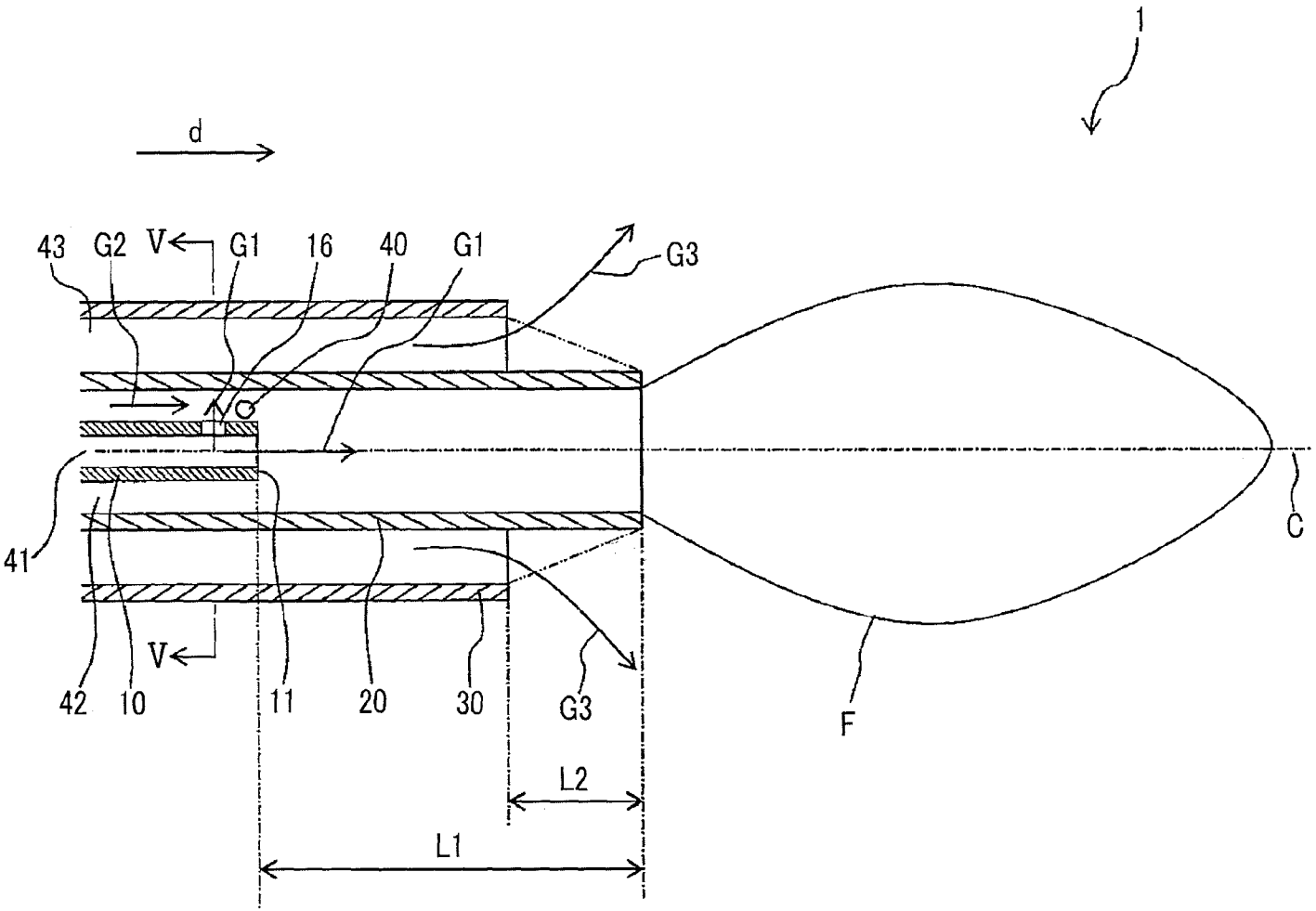
FIG. 4 is a schematic sectional view of a hydrogen gas burner structure according to a second embodiment.
Figure 5:
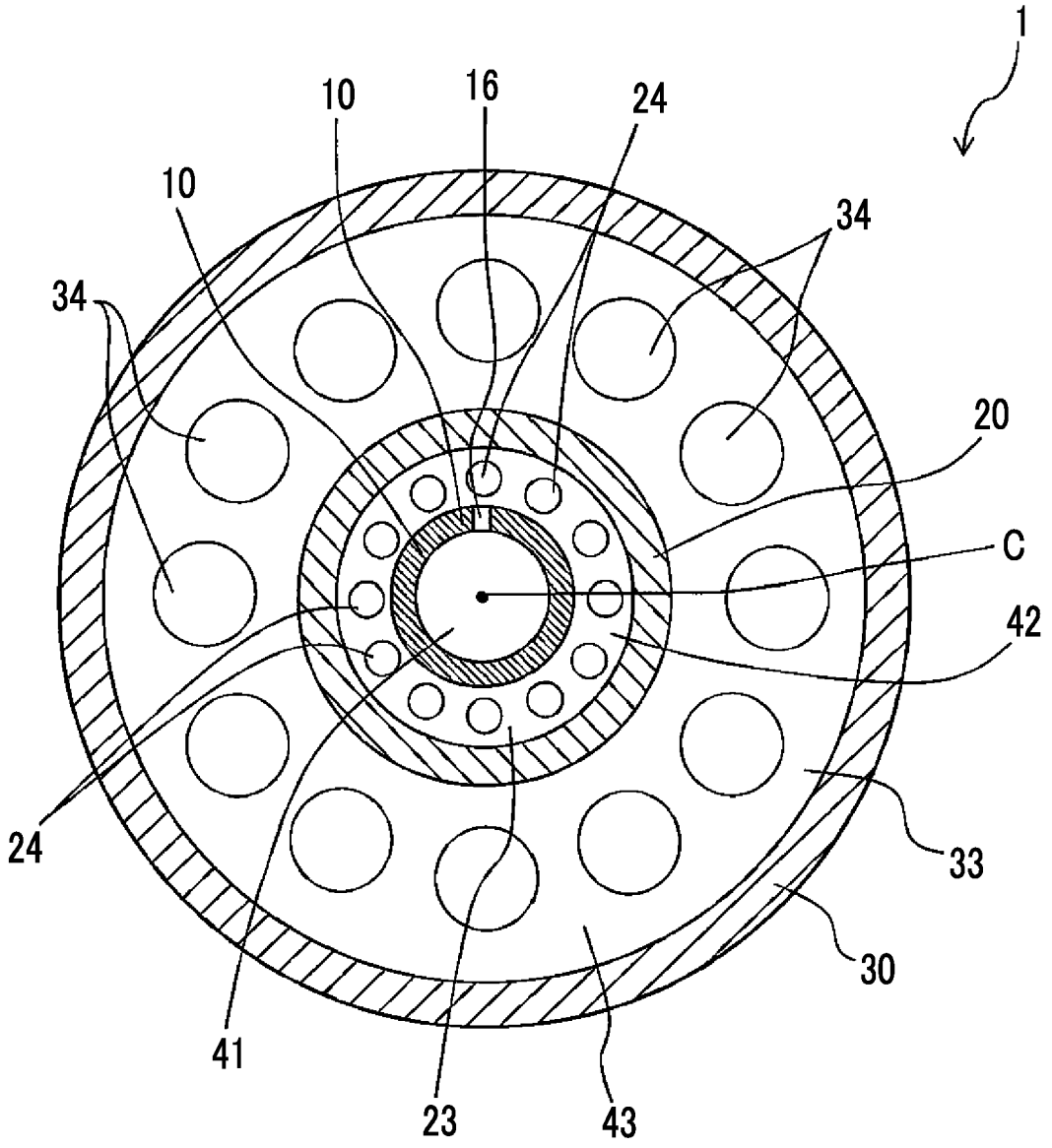
FIG. 5 is a sectional view in an arrow direction taken along line V-V illustrated in FIG. 4.

FIG. 4 is a schematic sectional view of a hydrogen gas burner structure 1 according to a second embodiment, and FIG. 5 is a sectional view in an arrow direction taken along line V-V illustrated in FIG. 4. The hydrogen gas burner structure according to the second embodiment is different from the hydrogen gas burner structure according to the first embodiment in terms of providing a through-hole in the first cylinder tube and the position of the ignition device. Hence, the detailed description of the same configuration as that of the first embodiment will be omitted.

The hydrogen gas burner structure 1 according to the present embodiment includes a through-hole 16, which allows the first flow passage 41 and the second flow passage 42 to communicate with each other, in a tube wall in the vicinity of the tip 11 of the first cylinder tube 10. Additionally, the ignition device 40 is disposed downstream of the through-hole 16 in the gas flow direction d.

Accordingly, a small amount of the hydrogen gas G1 passing through the through-hole 16 and the first combustion-supporting gas G2 passing through the second flow passage 42 can be mixed with each other, and the mixed gas can be ignited by the ignition device 40 upstream of the tip 11 of the first cylinder tube 10 in the gas flow direction d. As results as described above, since there is no need for disposing the ignition device 40 downstream of the tip 11 of the first cylinder tube 10 with relatively high heat generation density (energy density), the lifespan of the ignition device 40 can be improved.

Third Embodiment

Figure 6:
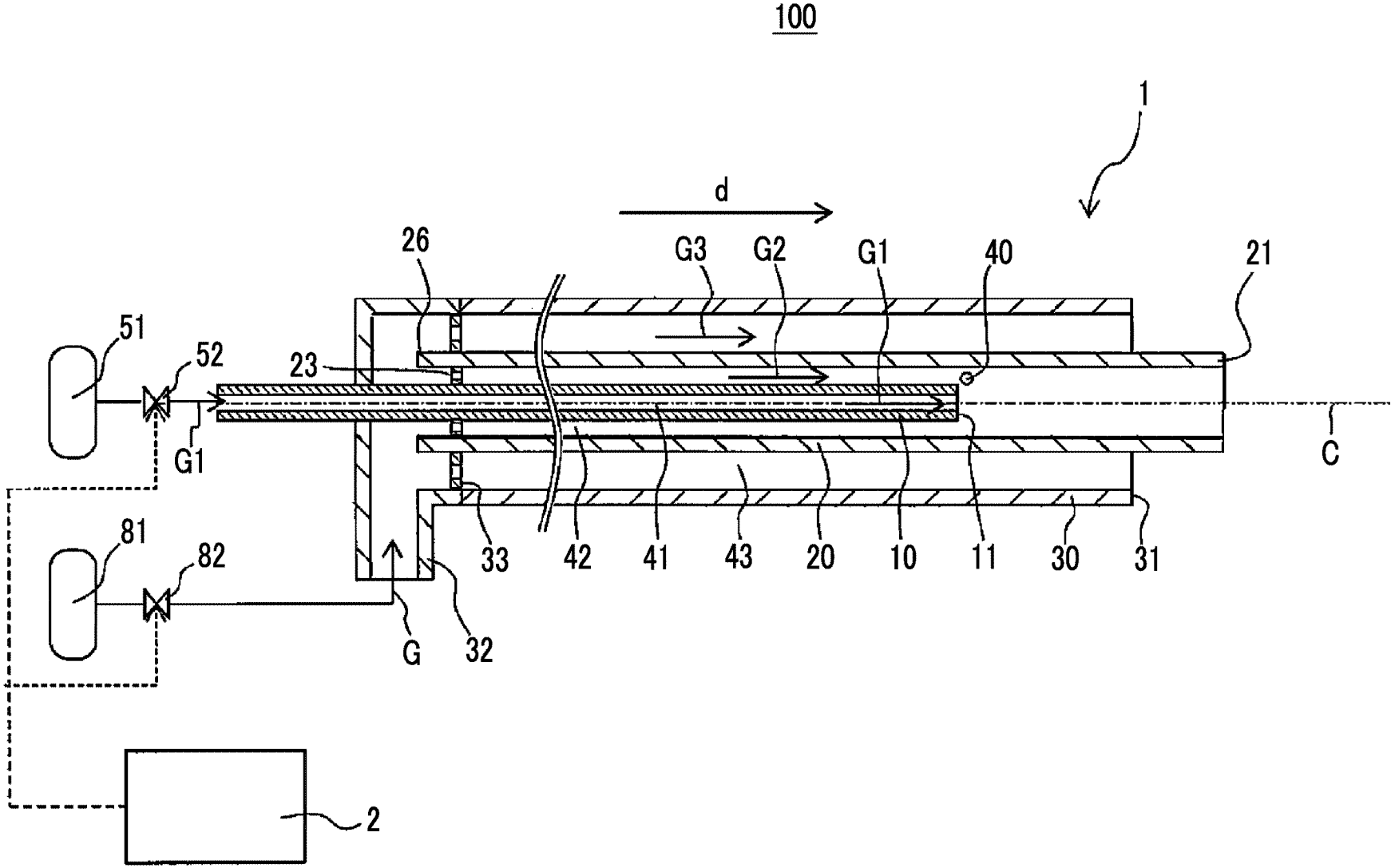
FIG. 6 is a schematic sectional view of a hydrogen gas burner structure according to a third embodiment.

FIG. 6 is a schematic sectional view of a hydrogen gas burner structure according to a third embodiment. As illustrated in FIG. 6, the hydrogen gas burner structure according to the third embodiment is different from the hydrogen gas burner structure according to the first embodiment in that a base end 26 of the second cylinder tube 20 is allowed to communicate with the inside of the connecting part 32 of the third cylinder tube 30 and the first and second combustion-supporting gases G2, G3 are supplied from a combustion-supporting gas supply source 81 via a common flow rate adjusting valve 82. Hence, the detailed description of the same configuration as that of the first embodiment will be omitted.

In the present embodiment, the second cylinder tube 20 is sandwiched between the straightening plates 23, 33 on the base end 26 side. The second cylinder tube 20 is open at the base end 26 of the second cylinder tube 20, and is disposed within the connecting part 32 of the third cylinder tube 30. The third cylinder tube 30 is connected to the connecting part 32, and the connecting part 32 is connected to the combustion-supporting gas supply source 81 that supplies a combustion-supporting gas G containing oxygen, such as air, via a flow rate adjusting valve 82. Hence, the first and second combustion-supporting gases G2, G3 are supplied from the common combustion-supporting gas supply source 81, and the total flow rate of the first and second combustion-supporting gases G2, G3 is adjusted by one flow rate adjusting valve 82.

Here, a plurality of through-holes 24, 34 is formed in an array state illustrated in FIG. 3 such that the respective straightening plates 23, 33 have a flow rate sectional area ratio according to a flow rate ratio of the first and second combustion-supporting gases G2, G3 that are caused to flow to the second and third flow passages 42, 43. Specifically, the flow rate sectional area ratio of the straightening plates 23, 33 is set by setting the apertures of the respective through-holes 24, 34 of the straightening plates 23, 33 such that the flow rate of the first combustion-supporting gas G2 flowing through the second flow passage 42 is lower than the flow rate of the second combustion-supporting gas G3 flowing through the third flow passage 43.

As described above, the respective straightening plates 23, 33 in which the through-holes 24, 34 are formed serve as throttle parts that keep the flow rate ratio of the first and second combustion-supporting gases G2, G3 flowing to the second and third flow passages 42, 43 constant. Also, even when the control device 2 adjusts (controls) the valve opening degree of the flow rate adjusting valve 82, the first and second combustion-supporting gases G2, G3 can be caused to flow to the second and third flow passages 42, 43 with a constant throttling ratio (a constant flow rate ratio of the first and second combustion-supporting gases G2, G3).

Moreover, the control device 2 controls (adjusts) the flow rates of the respective gases so as to adjust the valve opening degrees of the flow rate adjusting valves 52, 82 based on control signals output from the control device 2 and so as to supply the respective gases to the hydrogen gas burner structure 1 at the set flow rates of the respective gases. In the present embodiment, the control device 2 outputs a control signal such that the flow rate of the hydrogen gas G1 satisfies a relationship with the flow rate of the first combustion-supporting gas G2 illustrated in the first embodiment. Accordingly, the control device 2 drives the flow rate adjusting valves 52, 82, and adjusts the valve opening degrees of the flow rate adjusting valves 52, 82. The second combustion-supporting gas G3 flows through the third flow passage 43 in a flow rate ratio that is constant with respect to the first combustion-supporting gas G2.

As described above, in the present embodiment, the combustion-supporting gas G from the combustion-supporting gas supply source 81 can be split into the first and second combustion-supporting gases G2, G3 in a constant flow rate ratio by one flow rate adjusting valve 82. Thus, the configuration of the device is simplified compared to that of the first embodiment. In addition, the structure of the present embodiment may be applied to the hydrogen gas burner device 100 of the second embodiment.

Hereinafter, examples according to the present disclosure will be described.

Example 1

The hydrogen gas G1 was combusted using the hydrogen gas burner device 100 including the hydrogen gas burner structure 1 according to the second embodiment. Specifically, the internal diameter of the first cylinder tube 10 was 16 mm and the external diameter thereof was 34 mm, the internal diameter of the second cylinder tube 20 was 93 mm and the external diameter thereof was 102 mm, and the internal diameter of the third cylinder tube 30 was 118 mm, and the external diameter thereof was 128 mm. The distance L1 from the tip 21 of the second cylinder tube 20 to the tip 11 of the first cylinder tube 10 was 160 mm. The distance L2 from the tip 21 of the second cylinder tube 20 to the tip 31 of the third cylinder tube 30 was 80 mm.

Figure 7:
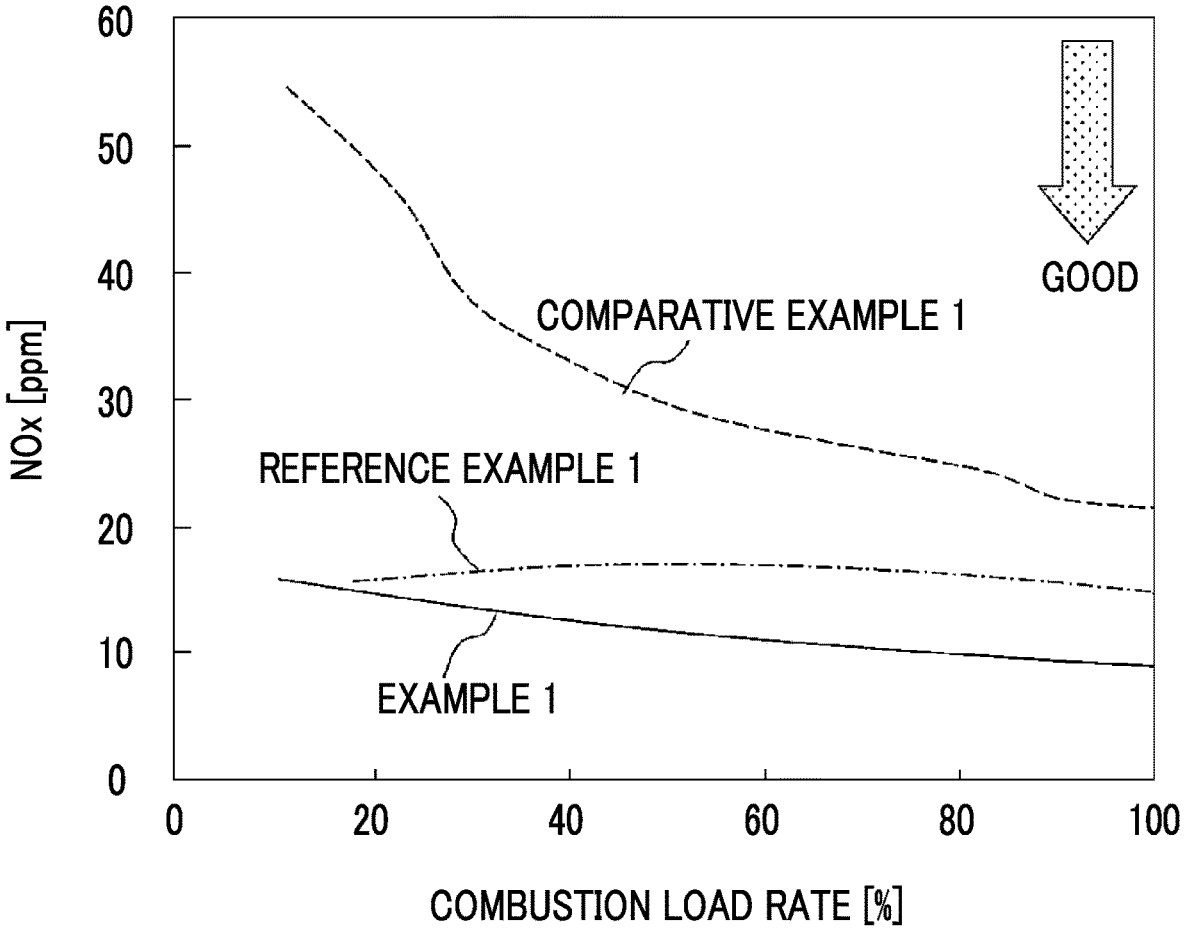
FIG. 7 is a view illustrating a relationship between a combustion load rate and the concentration of NOx according to Example 1, Comparative Example 1, and Reference Example 1.

Next, the hydrogen gas G1 was caused to flow to the first flow passage 41 while the control device changes the flow rate of the hydrogen gas G1 such that the combustion load rate of the hydrogen gas burner device 100 varies. Air was used for the first combustion-supporting gas G2 flowing to the second flow passage 42 and the second combustion-supporting gas G3 flowing to the third flow passage 43. Additionally, the first combustion-supporting gas G2 was caused to flow to the second flow passage 42 so as to have a flow rate of 5% of the flow rate at which the hydrogen gas G1 flowing to the first flow passage 41 was completely combusted. The second combustion-supporting gas G3 was caused to flow to the third flow passage 43 so as to have a flow rate at which the hydrogen gas G1 that has not been combusted due to the shortage of the first combustion-supporting gas G2 is completely combusted. The concentration of NOx included in an exhaust gas after combustion accompanying a change in the combustion load rate was measured. The results of the measurement are illustrated in FIG. 7.

Comparative Example 1

A hydrogen gas burner device in which the tip 11 of the first cylinder tube 10 of the hydrogen gas burner device 100 illustrated in FIG. 1 was blocked and a plurality of through-holes communicating with the second flow passage 42 was provided in the peripheral wall in the vicinity of the tip 11 of the first cylinder tube 10 was prepared. In Comparative Example 1, the hydrogen gas G1 was caused to flow to the first flow passage 41 while changing the flow rate of the hydrogen gas G1 such that the combustion load rate of the hydrogen gas burner device 100 varies. The second combustion-supporting gas G3 was not caused to flow and the first combustion-supporting gas G2 was caused to flow. Additionally, the first combustion-supporting gas G2 was caused to flow to the second flow passage 42 so as to have the flow rate at which the hydrogen gas G1 flowing to the first flow passage 41 was completely combusted. The concentration of NOx included in an exhaust gas after combustion accompanying a change in the combustion load rate was measured. The results of the measurement are illustrated in FIG. 7.

Reference Example 1

The concentration of NOx included in an exhaust gas after combustion accompanying a change in the combustion load rate was measured using a hydrogen gas burner device of Comparative Example 1. In Reference Example 1, there is a difference in that a hydrocarbon-based natural gas (town gas) is used instead of the hydrogen gas.

Result 1

As illustrated in FIG. 7, in the hydrogen gas burner device 100 including the hydrogen gas burner structure 1 according to Example 1, the concentration of NOx in the exhaust gas after combustion was lower than that of Comparative Example 1. Additionally, the concentration of NOx in an exhaust gas after combustion according to Reference Example 1 was lower than that of Comparative Example 1.

From the above results, in the hydrogen gas burner device of Comparative Example 1, it is considered that the hydrogen gas G1 was combusted at a time in a narrow space by blocking the tip 11 of the first cylinder tube 10 and actively mixing the hydrogen gas G1 with the first combustion-supporting gas G2 from the through-holes of the peripheral wall in the vicinity of the tip 11 of the first cylinder tube 10. Accordingly, it is considered that the temperature of the flame F became high and consequently, the concentration of NOx became higher than that of Example 1.

On the other hand, in Reference Example 1, a natural gas was used. Thus, the combustion speed of the natural gas is slower than that of the hydrogen gas. Therefore, it is considered that slow combustion occurs and the temperature of the flame F became lower than that of Comparative Example 1.

Example 2

Figure 8:
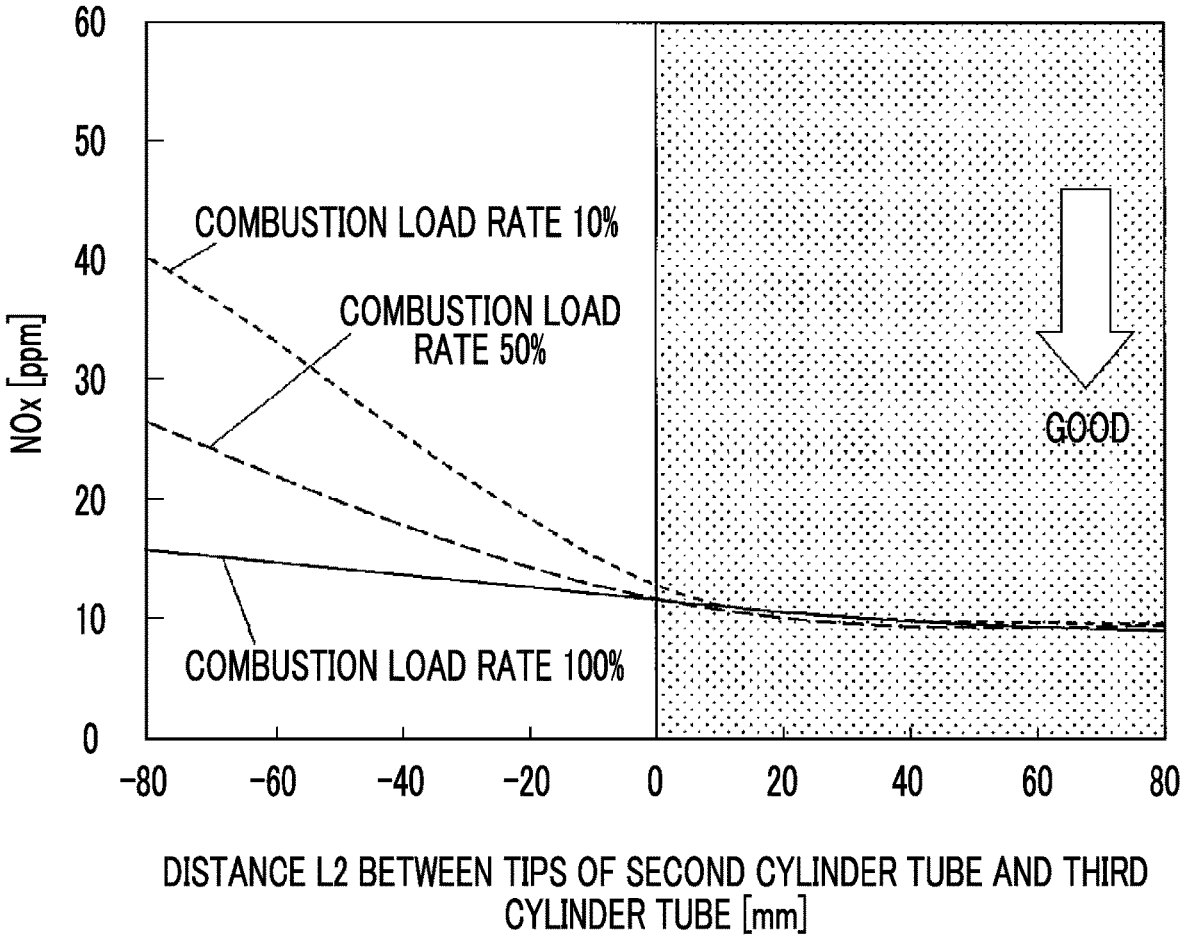
FIG. 8 is a view illustrating a relationship between a distance between tips of a second cylinder tube and a third cylinder tube, and the concentration of NOx.

In the same manner as in Example 1, the concentration of NOx in an exhaust gas after combustion was measured using the hydrogen gas burner device 100. Example 2 is different from Example 1 in that the hydrogen gas G1 was caused to flow to the first flow passage 41 on the condition that the combustion load rates of the hydrogen gas burner device 100 became 10%, 50%, and 100% and the distance L2 from the tip 21 of the second cylinder tube 20 to the tip 31 of the third cylinder tube 30 was changed from −80 mm to 80 mm with respect to the respective combustion load rates. In addition, a minus value of the distance L2 is a distance from the tip 21 of the second cylinder tube 20 of the tip 31 of the third cylinder tube 30 when the tip 31 of the third cylinder tube 30 is located upstream of the tip 21 of the second cylinder tube 20. A relationship between the distance between the tips of the second cylinder tube 20 and the third cylinder tube 30 and the concentration of NOx is illustrated in FIG. 8.

Result 2

In Comparative Example 1 described previously, as illustrated in FIG. 7, the concentration of NOx in the exhaust gas after combustion was about 50 ppm at a combustion load rate of 20%. However, as illustrated in FIG. 8, in Example 2, even when the combustion load rate was 10% and the distance L2 was −80 mm, the concentration of NOx in an exhaust gas after combustion was about 40 ppm. From the above-described results, it can be understood that the concentration of NOx in the exhaust gas after combustion in the hydrogen gas burner device of Example 2 is lower than that in Comparative Example 1 irrespective of the distance L2.

Moreover, from the results illustrated in FIG. 7, it is considered that the concentration of NOx can be reduced irrespective of the combustion load rate by making the distance L2 from the tip 21 of the second cylinder tube 20 to the tip 31 of the third cylinder tube 30 larger than 0 mm. Moreover, it is considered that the concentration of NOx can be more reliably reduced by making the distance L2 from the tip 21 of the second cylinder tube 20 to the tip 31 of the third cylinder tube 30 equal to or larger than 10 mm.

Although detailed description has been made above using the embodiments of the present disclosure, the specific configuration is not limited to the present embodiments and examples, and even when there are design changes without departing from the scope of the present disclosure, the design changes are also included in the scope of the present disclosure.

What is claimed is:

1. A hydrogen gas burner structure comprising:

a first cylinder tube of which a tip is open, wherein hydrogen gas flows inside of the first cylinder tube toward the tip of the first cylinder tube;

a second cylinder tube disposed outside the first cylinder tube concentrically with the first cylinder tube, wherein a first combustion-supporting gas containing oxygen gas, for primary combustion of the hydrogen gas, flows in a space between the first cylinder tube and the second cylinder tube toward a tip of the second cylinder tube;

a third cylinder tube disposed outside the second cylinder tube concentrically with the first cylinder tube and the second cylinder tube, wherein a second combustion-supporting gas containing oxygen gas, for secondary combustion of the hydrogen gas, flows in a space between the second cylinder tube and the third cylinder tube toward a tip of the third cylinder tube; and an ignition device disposed inside the second cylinder tube, wherein the ignition device ignites mixed gas obtained by mixing the hydrogen gas and the first combustion-supporting gas with each other, wherein the tip of the first cylinder tube is located upstream of the tips of the second and third cylinder tubes in a gas flow direction in which the hydrogen gas and the first combustion-supporting gas and the second combustion-supporting gas flow.

2. The hydrogen gas burner structure according to claim 1, wherein the tip of the third cylinder tube is located upstream of the tip of the second cylinder tube in the gas flow direction.

3. The hydrogen gas burner structure according to claim 1, wherein:

the first cylinder tube includes a through-hole, which allows an inside and an outside of a tube wall of the first cylinder tube to communicate with each other, in the tube wall in a vicinity of the tip of the first cylinder tube; and the ignition device is disposed downstream of the through-hole in the gas flow direction.

4. A hydrogen gas burner device comprising:

a first cylinder tube of which a tip is open, wherein hydrogen gas flows inside of the first cylinder tube toward the tip of the first cylinder tube;

a second cylinder tube disposed outside the first cylinder tube concentrically with the first cylinder tube, wherein a first combustion-supporting gas containing oxygen gas, for primary combustion of the hydrogen gas, flows in a space between the first cylinder tube and the second cylinder tube toward a tip of the second cylinder tube;

a third cylinder tube disposed outside the second cylinder tube concentrically with the first cylinder tube and the second cylinder tube, wherein a second combustion-supporting gas containing oxygen gas, for secondary combustion of the hydrogen gas, flows in a space between the second cylinder tube and the third cylinder tube toward a tip of the third cylinder tube; and an ignition device disposed inside the second cylinder tube, wherein the ignition device ignites mixed gas obtained by mixing the hydrogen gas and the first combustion-supporting gas with each other, a control device configured to control flow rates of the hydrogen gas and at least the first combustion-supporting gas, wherein the tip of the first cylinder tube is located upstream of the tips of the second and third cylinder tubes in a gas flow direction in which the hydrogen gas and the first combustion-supporting gas and the second combustion-supporting gas flow, the first combustion-supporting gas and the second combustion-supporting gas are the same combustion-supporting gas, and the control device is configured to control the flow rate of the first combustion-supporting gas such that the flow rate of the first combustion-supporting gas is lower than a flow rate at which the hydrogen gas is completely combusted and is lower than a flow rate of the second combustion-supporting gas.

* * * * *